United States Patent [19]

Naito et al.

[11] Patent Number: 4,483,914

[45] **Date of Patent: * Nov. 20, 1984**

[54] HEAT-DEVELOPABLE COLOR PHOTOGRAPHIC MATERIAL

[75] Inventors: Hideki Naito; Hiroshi Hara; Kozo Sato, all of Kanagawa, Japan

[73] Assignee: Fuji Photo Film Co., Ltd., Kanagawa, Japan

[ * ] Notice: The portion of the term of this patent subsequent to Oct. 2, 2001 has been disclaimed.

[21] Appl. No.: 439,170

[22] Filed: Nov. 4, 1982

[30] Foreign Application Priority Data

Nov. 5, 1981 [JP] Japan ..... 56-177611

[51] Int. Cl.[3] ..... G03C 5/54; G03C 1/40

[52] U.S. Cl. ..... 430/203; 430/226; 430/351; 430/543; 430/545

[58] Field of Search ..... 430/203, 226, 543, 351, 430/619, 545, 617, 618

[56] References Cited

U.S. PATENT DOCUMENTS

| | | | |
|---|---|---|---|
| 3,531,286 | 9/1970 | Renfrew | 430/351 |
| 3,761,270 | 9/1973 | de Mauriac et al. | 430/351 |
| 4,021,240 | 5/1977 | Cerquone et al. | 430/203 |
| 4,022,617 | 5/1977 | McGockin | 430/203 |

OTHER PUBLICATIONS

"Positive Images in Photothermographic Materials", Kohrt, *Research Disclosure, No. 16408, pp. 15 & 16, 12/1977.*

*Primary Examiner*—Richard L. Schilling

*Attorney, Agent, or Firm*—Sughrue, Mion, Zinn, Macpeak, and Seas

[57] ABSTRACT

A heat-developable color photographic material is disclosed. The material is comprised of a support having thereon a layer containing at least a light-sensitive silver halide, an organic silver salt oxidizing agent, a hydrophilic binder, a reducing agent for the silver halide and/or the organic silver salt oxidizing agent and a dye releasing compound which is capable of bonding to an oxidized product of the reducing agent and releasing a hydrophilic dye. The heat-developable color photographic material can easily provide a clear and stable color image by imagewise exposure to light and a heat development procedure. A method of forming a color image using the heat-developable color photographic material is also disclosed.

43 Claims, No Drawings

HEAT-DEVELOPABLE COLOR PHOTOGRAPHIC MATERIAL

FIELD OF THE INVENTION

The present invention relates to a process of forming a color image by heat development. Particularly, the present invention relates to a novel process for obtaining a color image by diffusion transfer of a dye released upon heat development of a heat-developable color photographic material containing a dye releasing compound which releases a hydrophilic diffusible dye upon heat development into a support which has a mordant layer.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of obtaining images with ease and rapidly have been developed by changing the conventional wet process using a developing solution into a dye process such as a process using heat, etc.

Heat-developable photographic materials are known in the field of these techniques, and heat-developable photographic materials and processes therefor have been described in U.S. Pat. Nos. 3,152,904, 3,301,678, 3,392,020 and 3,457,075, British Pat. Nos. 1,131,108 and 1,167,777, and Research Disclosure, No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and Research Disclosure, pages 31 and 32 (September, 1975) and the combination of a sulfonamidophenol type reducing agent and a 4-equivalent coupler as described in U.S. Pat. No. 4,021,240. These processes, however, are disadvantageous in that turbid color images are formed, because a reduced silver image and a color image are simultaneously formed on the exposed area after heat development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat development has been described in Research Disclosure, No. 16966, pages 54 to 58 (May, 1978). According to this process, clear images cannot be obtained, because it is difficult to control the release of dyes from nonexposed areas, and thus it is not a conventionally applicable process.

Also, processes for forming a positive color image by a silver dye bleach process utilizing heat development, with useful dyes and methods for bleaching have been described, for example, in Research Disclosure, No. 14433, pages 30 to 32 (April, 1976), ibid., No. 15227, pages 14 and 15 (December, 1976) and U.S. Pat. No. 4,235,957.

However, this process requires an additional step and an additional material for accelerating bleaching of dyes, for example, heating with a superposed sheet with an activating agent. Furthermore, it has a drawback that the resulting color images are gradually reduced and bleached by coexisting free silver during preservation for a long period of time.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

SUMMARY OF THE INVENTION

The present invention provides a novel process for forming a color image by heat development and eliminating drawbacks present in known materials.

Therefore, an object of the present invention is to provide a novel process for forming a color image which comprises heat transferring a hydrophilic dye released upon heat development into an image receiving material containing a mordant to obtain a color image.

Another object of the present invention is to provide a process for obtaining a clear color image by a simple procedure.

Still another object of the present invention is to provide a process for obtaining a color image which is stable for a long period of time.

These and other objects of the present invention will become more apparent from the following detailed description and examples.

These objects of the present invention are accomplished with a heat-developable color photographic material comprising a support having thereon a layer containing at least a light-sensitive silver halide, an organic silver salt oxidizing agent, a hydrophilic binder, a reducing agent for the silver halide and/or the organic silver salt oxidizing agent and a dye releasing compound which is capable of bonding to an oxidized product of the reducing agent and releasing a hydrophilic dye.

DETAILED DESCRIPTION OF THE INVENTION

The heat-developable color photographic material of the present invention can simultaneously provide a silver image having a negative-positive relationship to the original and a diffusible dye on the part corresponding to the silver image by only carrying out heat development after imagewise exposure to light. That is, when the heat-developable color photographic material of the present invention is imagewise exposed to light and developed by heating, an oxidation-reduction reaction occurs between an organic silver salt oxidizing agent and a reducing agent by means of exposed light-sensitive silver halide as a catalyst to form a silver image in the exposed area. In this step, the reducing agent is oxidized to form an oxidized product. This oxidized product causes a coupling reaction with the dye releasing compound and as a result a hydrophilic diffusible dye is released. Accordingly, the silver image and the diffusible dye are formed in the exposed area, and a color image is obtained by transferring the diffusible dye into a material having an image receiving layer.

The reaction of releasing a diffusible dye according to the present invention is wholly carried out at a high temperature from 80° C. to 250° C. and in a film without using a liquid such as a processing solution, etc. This releasing reaction of a diffusible dye and diffusion of the hydrophilic dye released are carried out at an unexpectedly high rate as shown in the examples hereinafter described.

The dye releasing compound which releases a diffusible dye which can be used in the present invention is represented by the following general formula:

C—L—D wherein C represents a substratum capable of bonding to an oxidized product which is formed by a reaction between a reducing agent and an organic silver salt oxidizing agent; D represents a dye portion for forming an image; and L represents a connecting group between C and D and the bond between C and L is cleaved upon the reaction of C with the oxidized product of the reducing agent.

The substratum represented by C which is capable of bonding to an oxidized product which is formed by a reaction between a reducing agent and an organic silver salt oxidizing agent includes an active methylene residue, an active methine residue, a phenol residue, a naphthol residue, etc. Preferred examples of the substrata are represented by the following general formulae (I) to (VII)

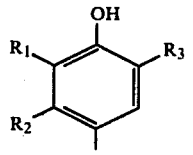
(I)

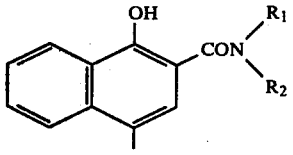
(II)

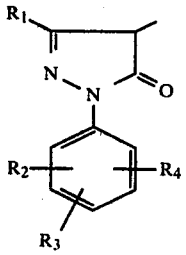
(III)

$R_1COCHCOR_2$
|
(IV)

-continued

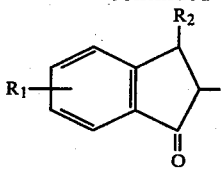
(V)

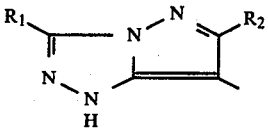
(VI)

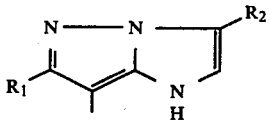
(VII)

wherein $R_1$, $R_2$, $R_3$ and $R_4$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group. The total number of the carbon atoms contained in the groups of $R_1$, $R_2$, $R_3$ and $R_4$ is from 12 to 40.

The substratum represented by C has a function of releasing a diffusible dye when bonding to an oxidized product of the reducing agent and should contain a ballast group in order to prevent diffusion of the dye releasing compound per se into an image receiving layer which is capable of receiving a dye. Preferred examples of the ballast groups include a hydrophobic group, for example, an alkyl group, an alkoxyalkyl group, an aryloxyalkyl group, etc. It is preferred that the total number of the carbon atoms contained in the ballast group is from 6 to 40 and that the total number of the carbon atoms contained in the substratum of C is from 12 to 40.

Specific examples of preferred substrata represented by C are set forth below, but the present invention is not to be construed as being limited thereto.

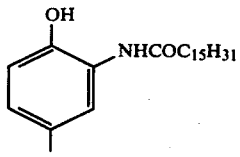
(C-1)

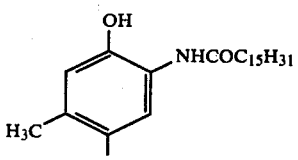
(C-2)

-continued
(C-3)
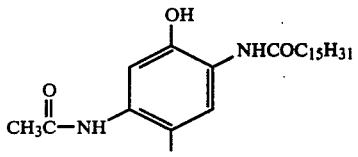
(C-4)
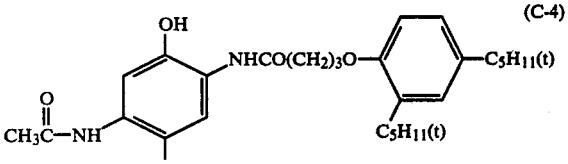
(C-5)
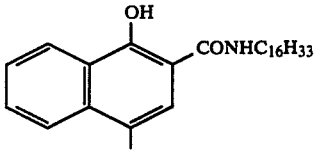
(C-6)
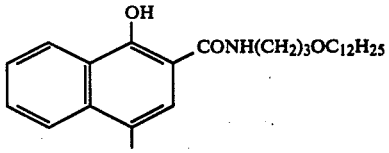
(C-7)
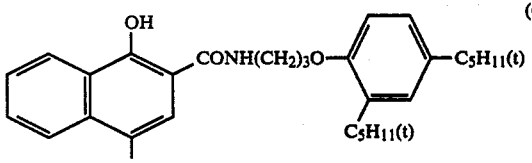
(C-8)
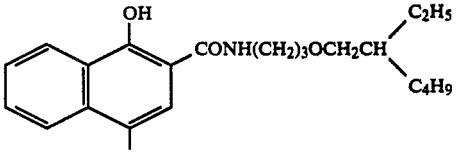
(C-9)
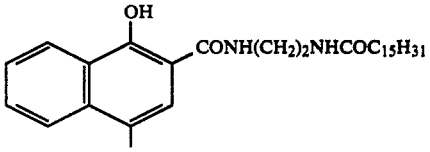
(C-10)
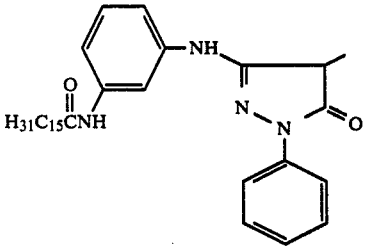
-continued
(C-11)
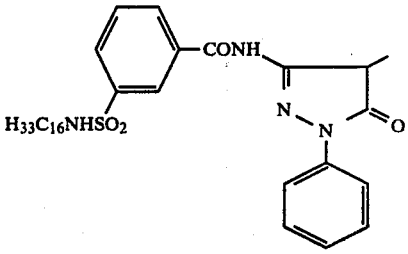
(C-12)
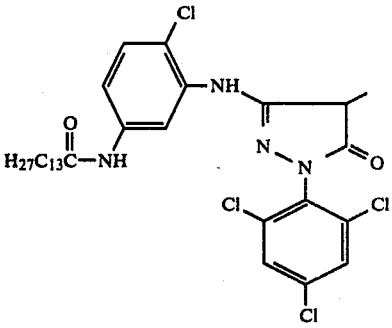
(C-13)
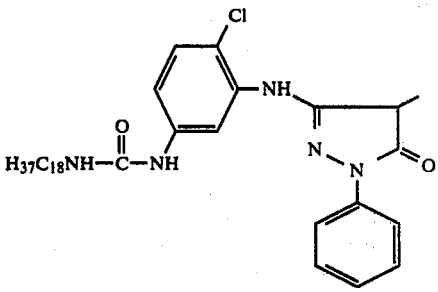
(C-14)
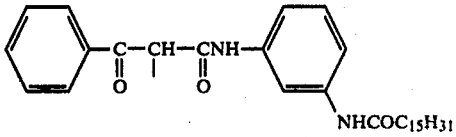
(C-15)
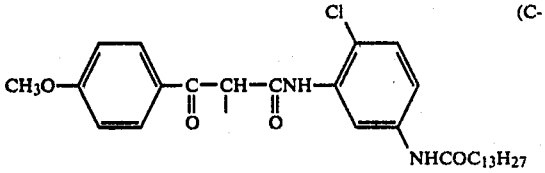
(C-16)
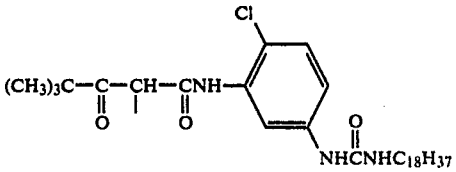
(C-17)
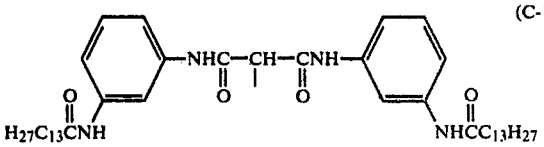

-continued (C-18)

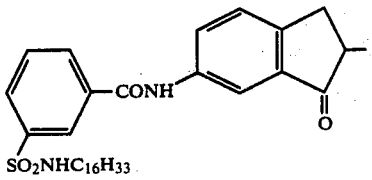

The connecting group represented by L is a group connecting between the substratum C and the dye portion D with a covalent bond and it also acts as a releasable group in the reaction of the oxidized product of the reducing agent with the substratum C. The connecting group L includes a divalent residue selected from the groups represented by the following general formulae:

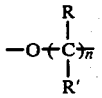

n = 0~3

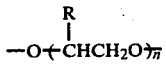

n = 1~2

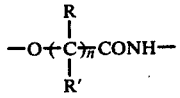

n = 0~3

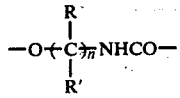

n = 1~3

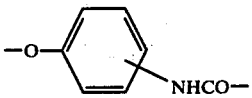

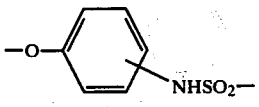

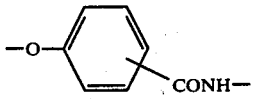

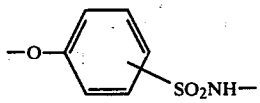

—NHCONH—

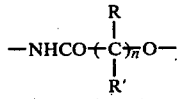

n = 0~3

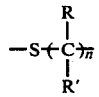

n = 0~3

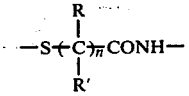

n = 1~3

-continued

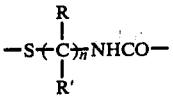

n = 1~3

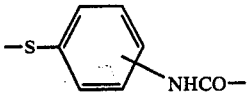

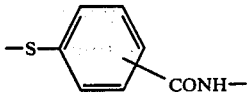

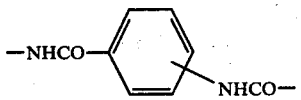

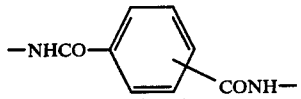

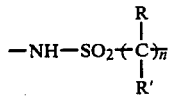

n = 0~3

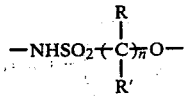

n = 1~4

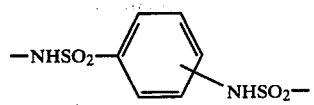

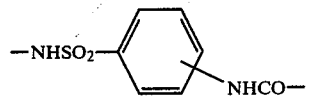

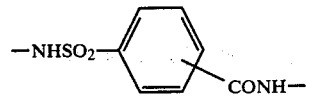

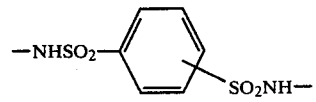

—NHSO₂NHCONH—

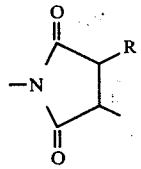

-continued

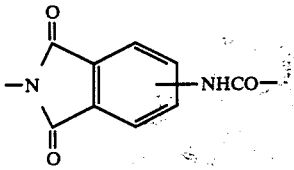

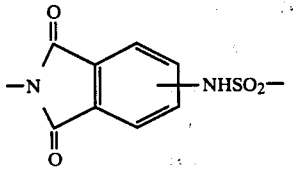

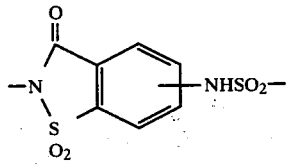

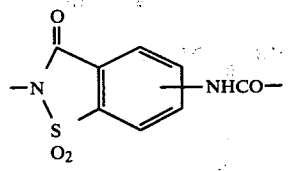

In the above formulae, R and R′, which may be the same or different, each represents hydrogen, a methyl group or an ethyl group, and the benzene ring may further be substituted with a hydroxy group, a sulfamoyl group, a methyl group, an ethyl group, an alkoxy group, a hydroxyalkyl group, a hydroxyalkoxy group, an alkoxyalkoxy group or a halogen atom.

Of these connecting groups, those containing the total number of the carbon atoms of not more than 12 are preferred. Those having a large hydrophilic property provide preferred results. Typical examples of the preferred connecting groups represented by L are set forth below, but the present invention is not to be construed as being limited thereto.

$-O-CH_2CH_2-$ (L-1)

$-O-CH_2CH_2CH_2-$ (L-2)

$-O-CH_2CONH-$ (L-3)

$-O-CH_2CH_2CONH-$ (L-4)

$-O-CH(CH_3)-$ (L-5)

$-O-CH(CH_3)-CH_2-$ (L-6)

$-O-CH_2CH(CH_3)-$ (L-7)

$-O-CH_2CH_2O-$ (L-8)

$-O-CH(CH_3)CH_2O-$ (L-9)

$-O-CH(CH_3)-CONH-$ (L-10)

-continued $-O-C(CH_3)_2-CONH-$ (L-11)

$-OCH_2CH_2NHCO-$ (L-12)

$-O-CH_2CH_2CH_2NHCO-$ (L-13)

(L-14)

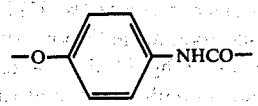

(L-15)

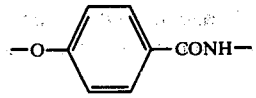

(L-16)

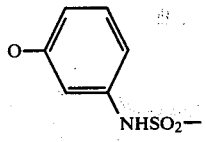

(L-17)

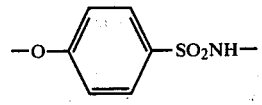

(L-18)

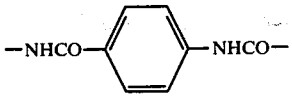

(L-19)

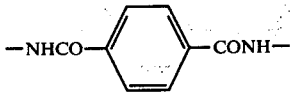

(L-20)

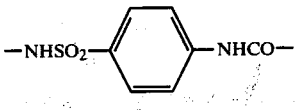

(L-21)

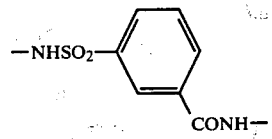

(L-22)

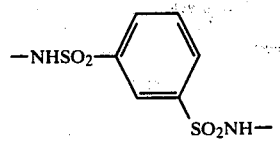

$-NHSO_2CH_2CH_2CH_2O-$ (L-23)

$-NHSO_2NHCONH-$ (L-24)

(L-25)

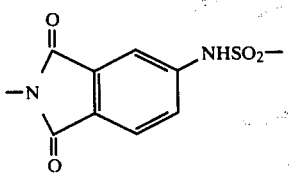

-continued (L-26)

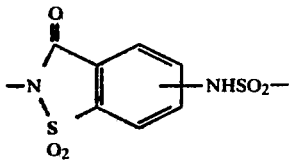

Examples of dyes which can be used for image forming dyes (the dye portions represented by D) include an azo dye, an azomethine dye, an anthraquinone dye, a naphthoquinone dye, an indigoid dye, a carbonium ionic dye, a styryl dye, a quinoline dye, a nitro dye and a phthalocyanine dye, etc. Typical examples of the dyes are set forth below and are classified by hue. However, the present invention is not to be construed as being limited thereto.

Yellow:

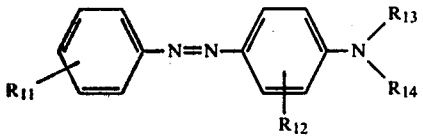

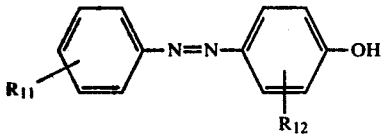

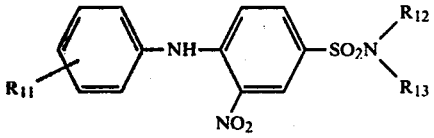

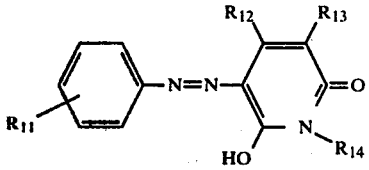

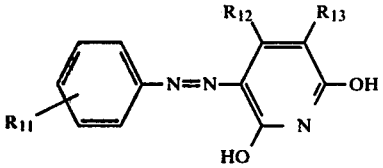

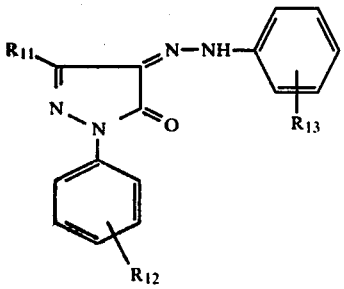

-continued

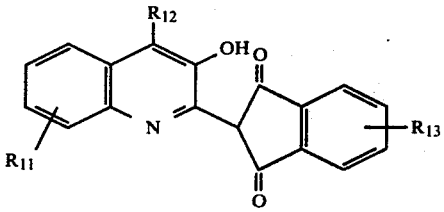

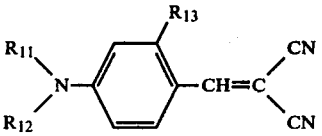

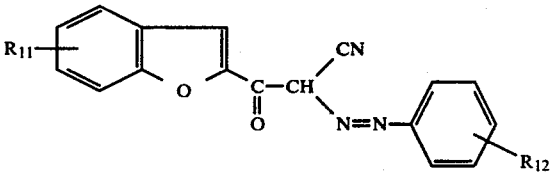

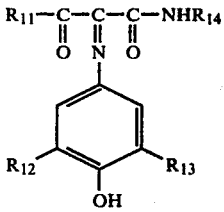

Magenta:

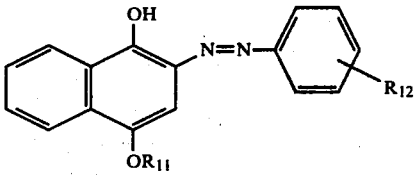

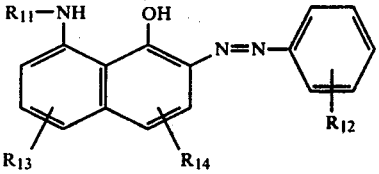

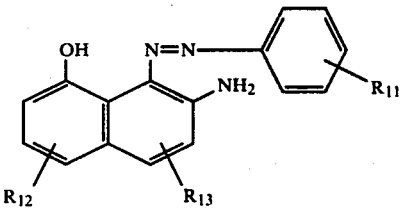

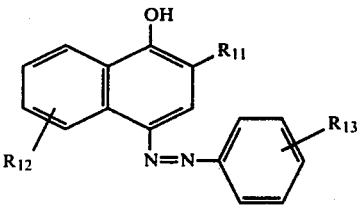

-continued
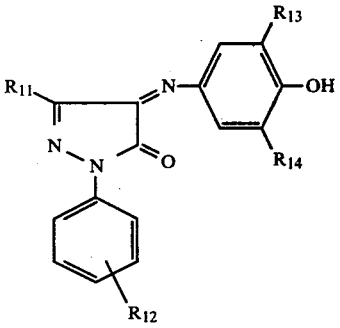
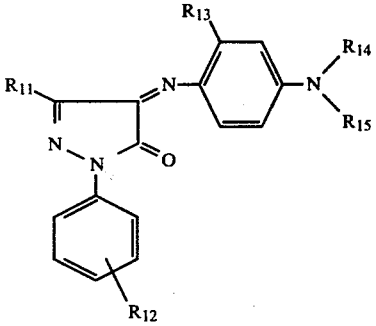
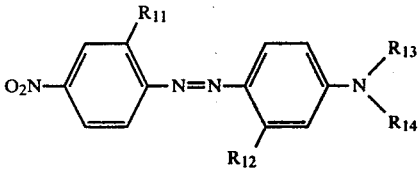
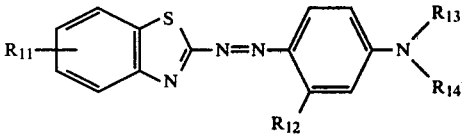
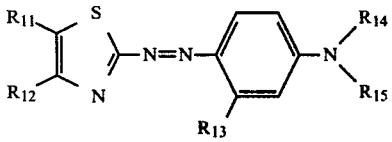
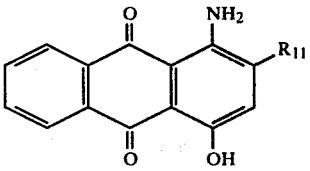
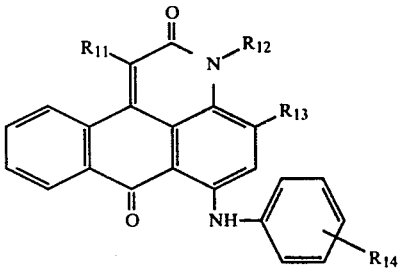
-continued
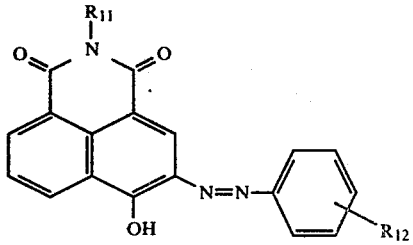
Cyan:
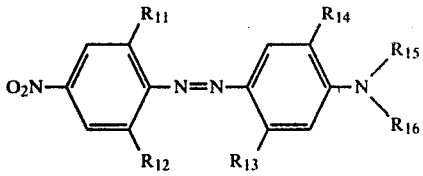
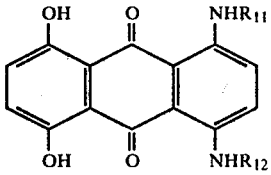
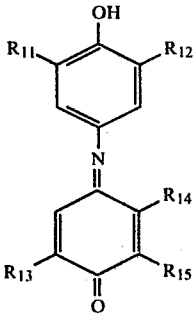
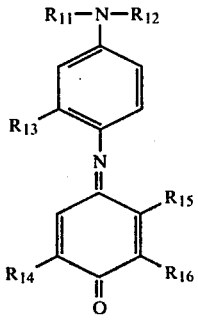
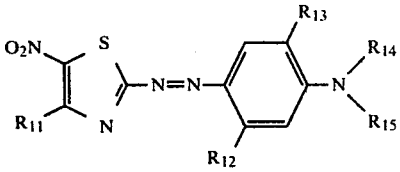
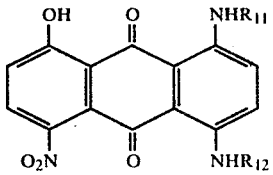

-continued

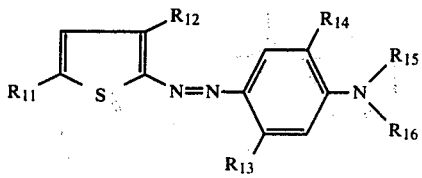

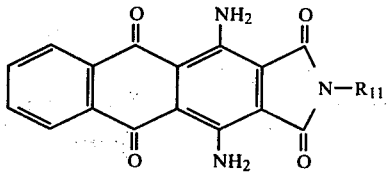

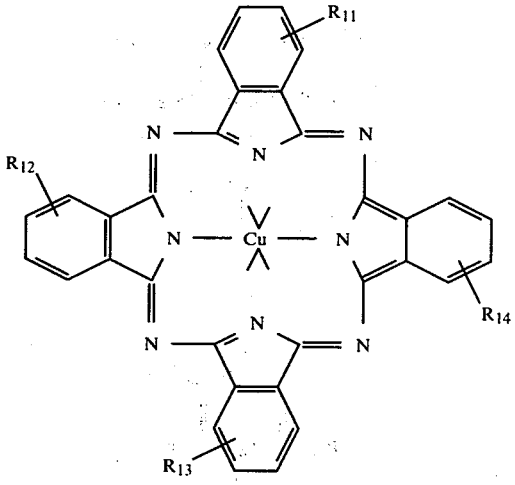

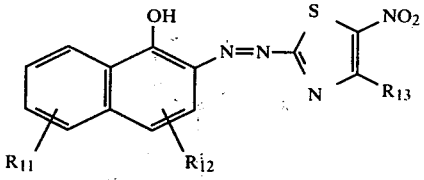

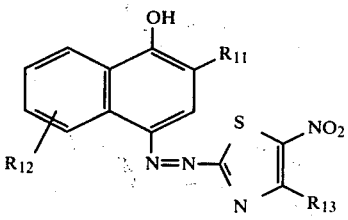

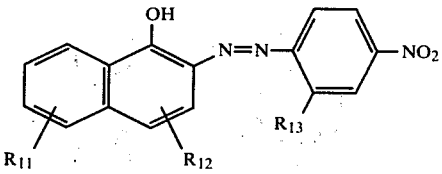

-continued

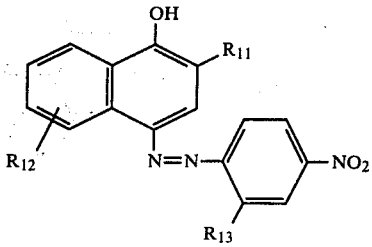

In the above formulae, $R_{11}$ to $R_{16}$, which may be the same or different, each represents hydrogen or a substituent selected from an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxy-carbonylalkyl group, an alkoxyalkyl group, an aryloxy-alkyl group, a nitro group, a halogen atom, a sulfamoyl group, an N-substituted sulfamoyl group, a carbamoyl group, an N-substituted carbamoyl group, a sulfamido group, an N-substituted sulfamido group, a hydroxyalkoxy group, an alkoxyalkoxy group, a carboxy group, an amino group, a substituted amino group, an alkylthio group, an arylthio group, a hydroxamic acid group and an imido group, each having up to 25 carbon atoms.

Characteristics required for the image forming dyes are as follows.

1. It is hydrophilic, has good diffusibility in an aqueous medium and can effectively diffuse into an image receiving sheet and provide high optical density tinting.
2. It has a hue suitable for color reproduction.
3. It has a large molecular extinction coefficient.
4. It is stable with respect to light and heat and other additives included in the system; such as the reducing agent, and with respect to the dye releasing activator, and
5. It is easily synthesized and it is possible to introduce the dye into the substratum C.

Examples of the group imparting the hydrophilicity include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition ($pKa < 12$) are particularly preferred. Examples of these groups include a phenolic hydroxy group, a carboxy group, a sulfo group, a phosphoric acid group, an imido group, a hydroxamic acid group, a substituted or unsubstituted sulfamoyl group or a substituted or unsubstituted sulfamoylamino group, etc.

Specific examples of the preferred image forming dyes which satisfy the above-described requirements are set forth below, but the present invention is not to be construed as being limited thereto.

Yellow:
(D-1)
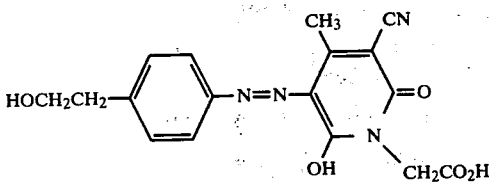
(D-2)
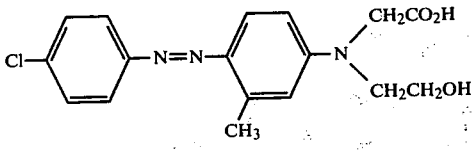
(D-3)
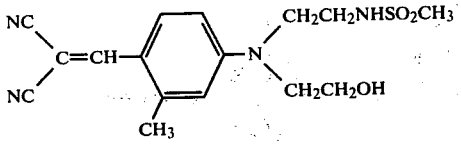
(D-4)
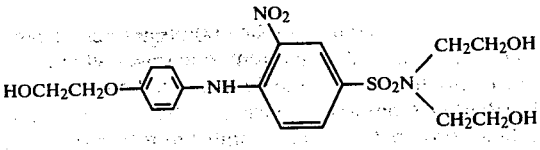
(D-5)
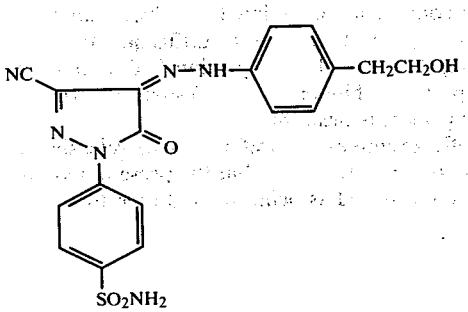
Magenta:
(D-6)
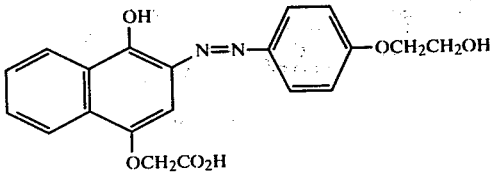
(D-7)
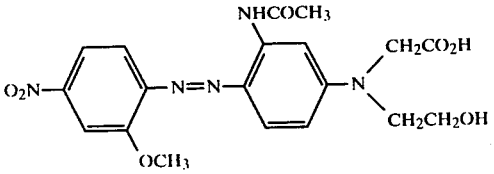
-continued
(D-8)
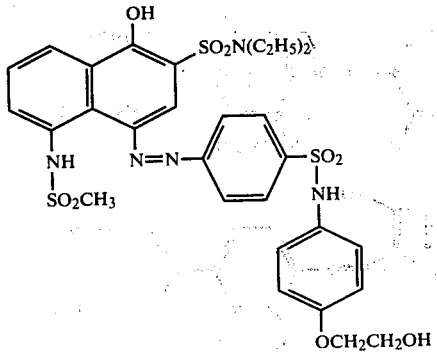
(D-9)
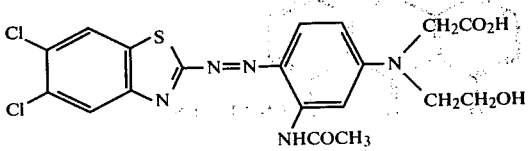
(D-10)
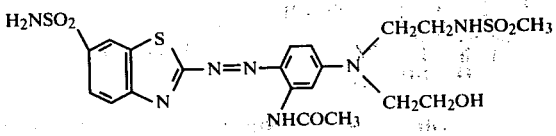
(D-11)
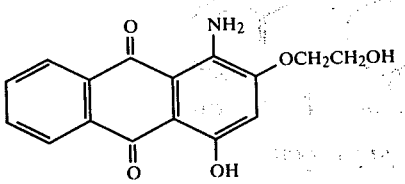
(D-12)
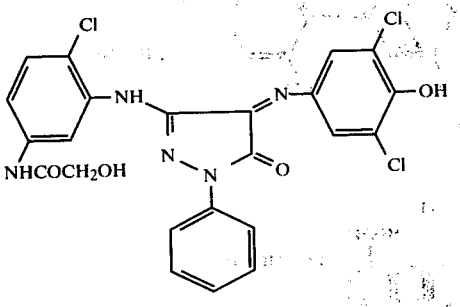
(D-13)
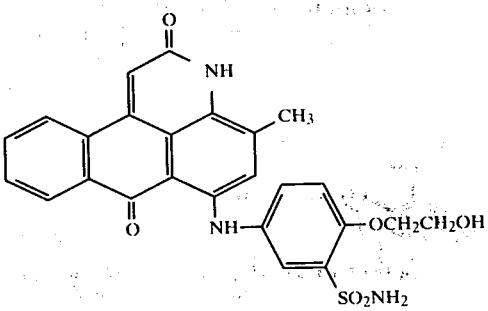
Cyan:

-continued (D-14)

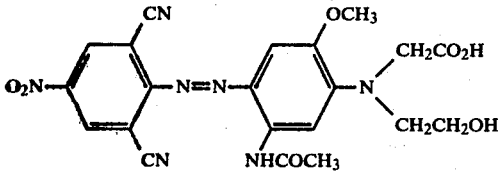

(D-15)

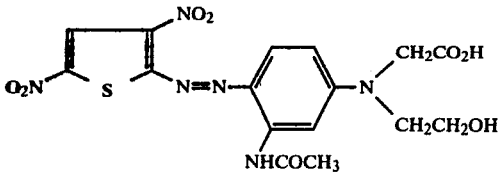

(D-16)

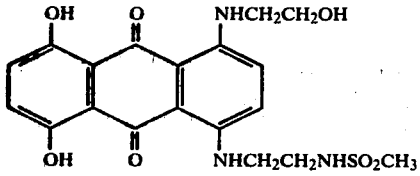

(D-17)

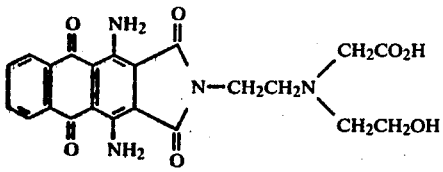

(D-18)

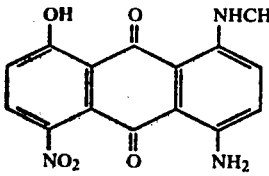

(D-19)

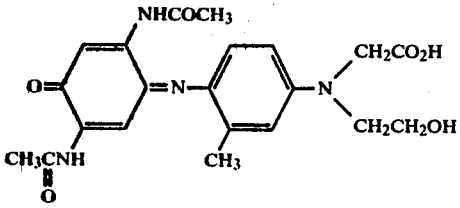

-continued (D-20)

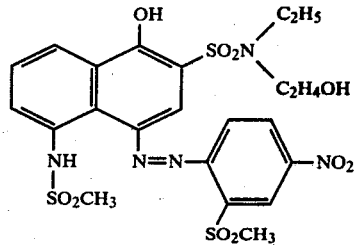

(D-21)

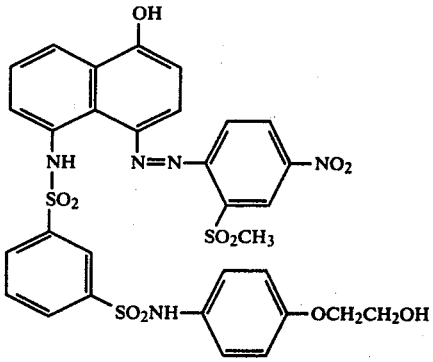

Useful image forming dyes include dye precursors, for example, a leuco body, a temporarily short-wave-shifted compound, etc.

It is preferred that a dye releasing compound capable of releasing a diffusible dye is a compound which does not diffuse into an image receiving sheet, and only a dye released therefrom upon the reaction with the oxidized product of the reducing agent tints the image receiving sheet in a high optical density. Therefore, the dye releasing compound in which the substratum C has a ballast group for preventing the diffusion into the image receiving sheet and the dye portion D does not contain a group which hinders the diffusion into the image receiving sheet is desirable.

Specific examples of preferred dye releasing compounds are set forth below, but the present invention is not to be construed as being limited thereto.

(1)

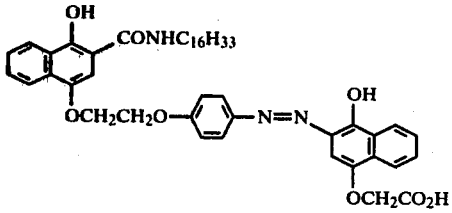

(2)

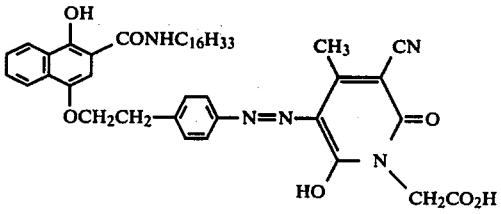

(3)

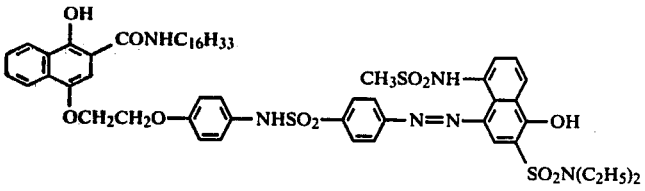

(4)

(5)

-continued
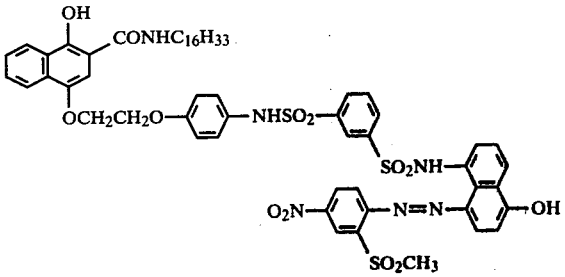
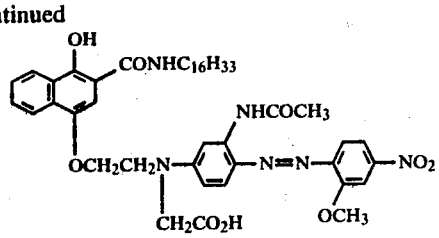
(6)
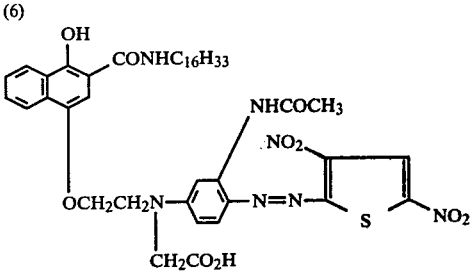
(7)
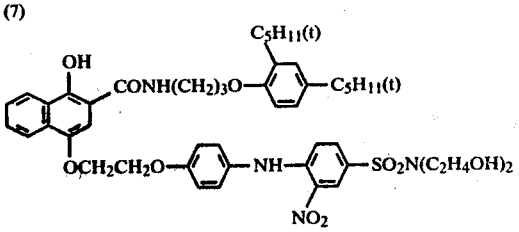
(8)
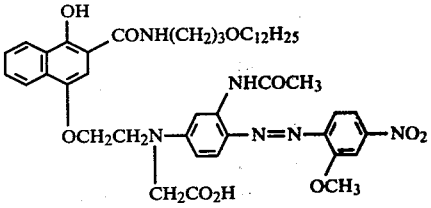
(9)
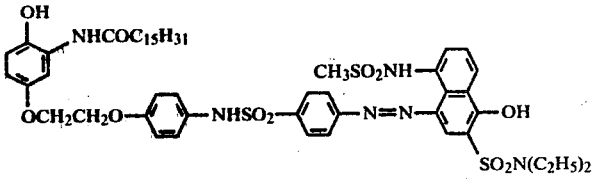
(10)
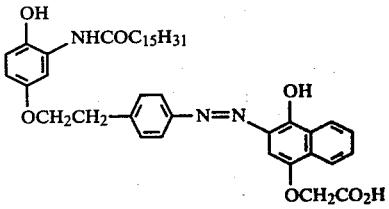
(11)
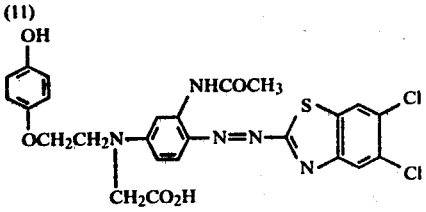
(12)
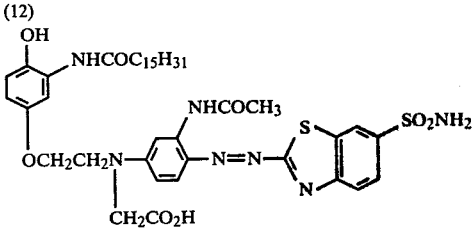
(13)
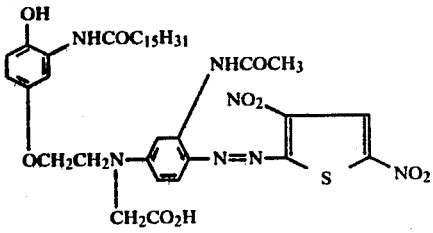
(14)
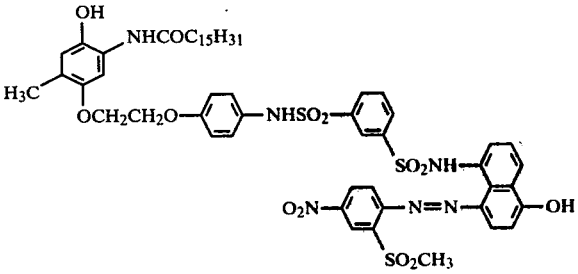
(15)
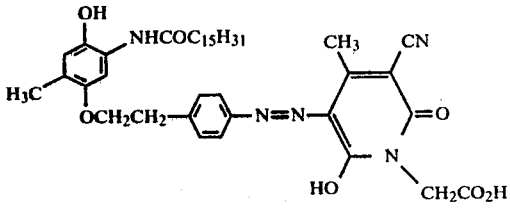
(16)

-continued

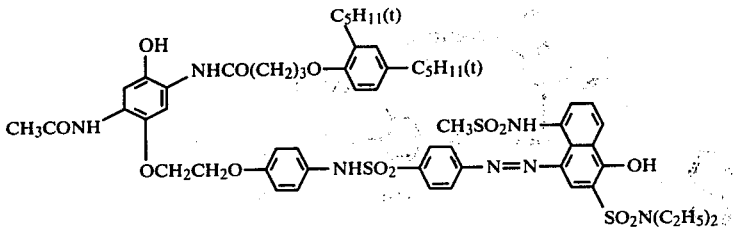

(17)

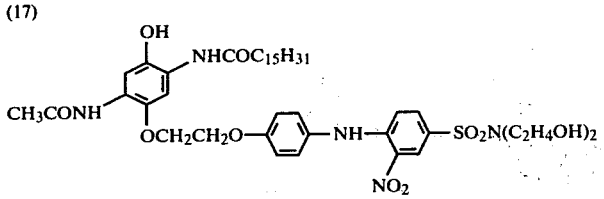

(18)

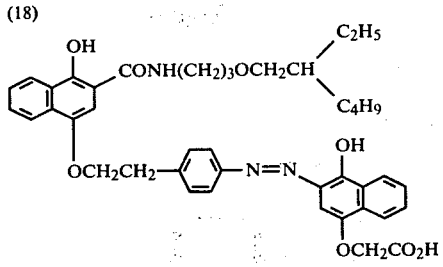

(19)

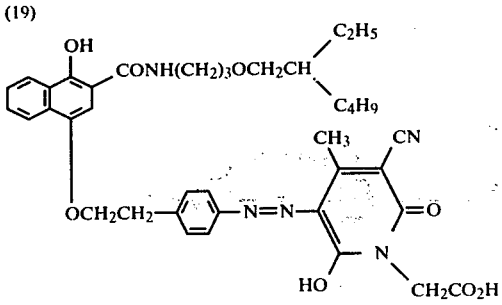

(20)

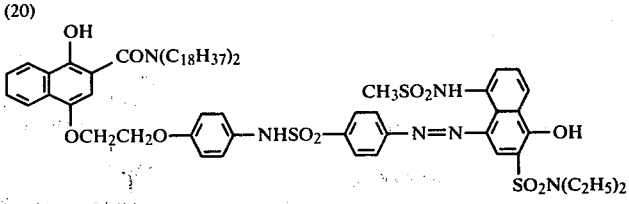

(21)

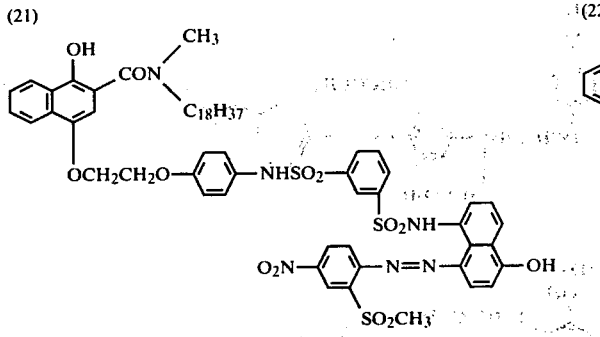

(22)

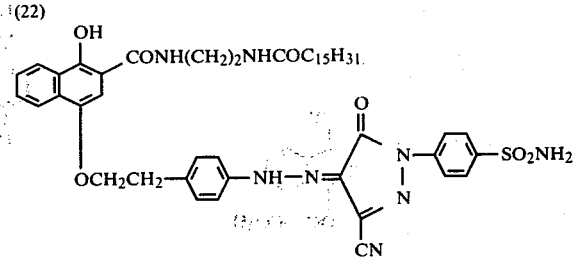

(23)

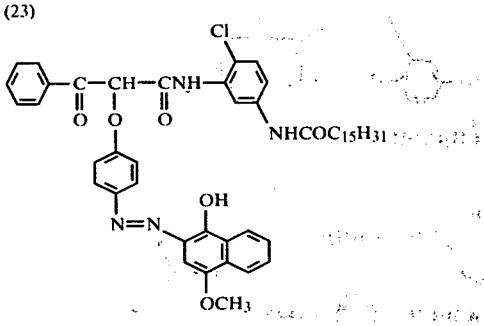

(24)

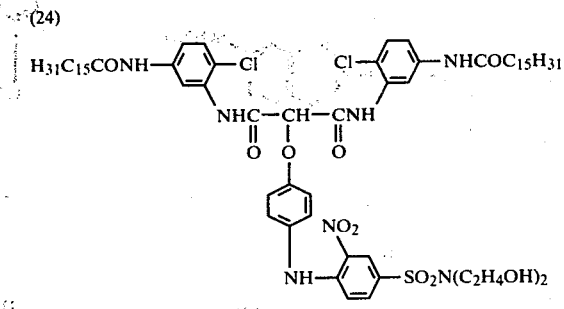

The synthesis method of the dye releasing compounds according to the present invention is described below. The dye releasing compound according to the present invention is represented by the following general formula:

B—C—L—D wherein C represents a substratum capable of bonding to the oxidized product of the reducing agent; B represents a ballast group; L represents a connecting group between C and D; and D represents a dye portion for forming an image. The dye releasing compound represented by the above described general formula can be generally synthesized according to the following two schemes:

Scheme 1:

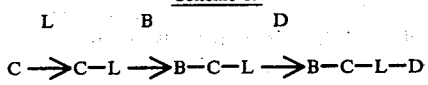

Scheme 2:

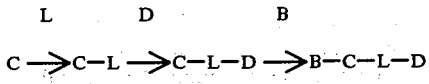

The decision on which method to be used depends on the kind of substratum C used. For example, when using a phenol type substratum or a naphthol type (both of which are particularly important), the former can be synthesized according to Scheme 2 and the latter can be synthesized according to Scheme 1. Further, the method for introducing the ballast group B is also different depending on the kind of the substratum C. For example, the introduction by acylation of an amino group at the 2-position in a phenol type substratum and the introduction by amidation of a carboxyl group (or an ester group) at the 2-position in a naphthol type compound are very general procedures. On the other hand, the introduction of the dye portion is usually carried out by a condensation reaction between a terminal group of the connecting group L and a terminal group of the dye portion D in the Scheme 1. However, this is carried out by an azo coupling method in Scheme 2. Specific examples for the synthesis of the dye releasing compounds are set forth below, but the present invention is not to be construed as being limited thereto.

SYNTHESIS EXAMPLE 1

Synthesis of Dye Releasing Compound (1)

1-a: Synthesis of 2-(N-Hexadecylcarbamoyl)-4-[2-(p-aminophenyl)ethoxy]-1-naphthol[1-a]

56 g (0.2 mol) of phenyl 1,4-dihydroxy-2-naphthoate was dissolved by heating in 100 ml of dimethylformamide and to which was added little by little 48.2 g (0.2 mol) of hexadecylamine at a temperature range between 20° C. and 30° C. After the completion of the addition, the mixture was heated at a temperature range between 70° C. and 80° C. for 3 hours. Then, 300 ml of methanol was added while the mixture was still hot and allowed to cool. The crystals thus deposited were collected by filtration and washed with methanol to obtain the compound of the formula shown below. Yield: 71 g.

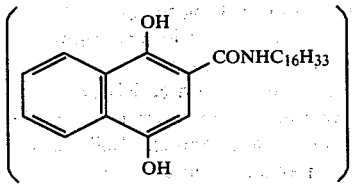

A mixture composed of 42.7 g (0.1 mol) of 1,4-dihydroxy-2-(N-hexadecylcarbamoyl)naphthalene, 50.1 g (0.3 mol) of 2-(p-nitrophenyl)ethanol, 19 g of p-toluenesulfonic acid and 600 ml of toluene was refluxed by heating for 5 hours and the resulting water was removed by azeotropic distillation. After allowing to cool, toluene was distilled from the reaction mixture under a reduced pressure and the residue was dissolved in ethyl acetate. After washing with water, the ethyl acetate was distilled off under a reduced pressure to concentrate and the residue was purified by a silica gel chromatography to obtain 28.2 g of 2-(N-hexadecylcarbamoyl)-4-[2-(p-nitriphenyl)ethoxy]-1-naphthol.

A mixture composed of 17.3 g (0.03 mol) of the crystals thus obtained, 2 g of ammonium chloride, 200 ml of isopropanol and 20 ml of water was heated at 50° C. Then, 12 g of a reduced iron was added little by little at a temperature range between 50° C. and 60° C. and the mixture was refluxed by heating for 1 hour. The mixture was filtered while it was still hot, the filtrate was allowed to cool and the crystals thus deposited were collected by filtration and washed with methanol to obtain 14.1 g of 2-(N-hexadecylcarbamoyl)-4-[2-(p-aminophenyl)ethoxy]-1-naphthol [1-a] of the formula shown below.

[1-a]

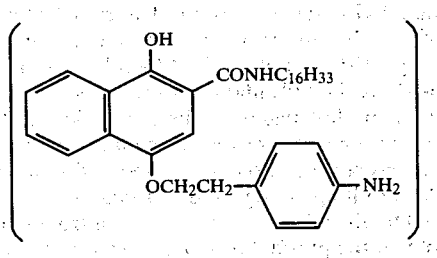

1-b: Synthesis of Dye Releasing Compound (1)

5.46 g (0.01 mol) of Compound [1-a] was dissolved by heating in 50 ml of methyl Cellosolve and to which was added 3 ml of hydrochloric acid followed by cooling to 10° C. 0.7 g of sodium nitrite was dissolved in 2 ml of water and the solution was added to the above described solution at a temperature range between 10° C. and 12° C. After stirring at 10° C. for 20 minutes, a small amount of sulfamic acid was added to the mixture and the excess nitrous acid was decomposed.

2.18 g (0.01 mol) of 4-carboxymethoxy-1-naphthol was dissolved in 20 ml of methyl Cellosolve and to which was added 40 ml of a 10% methanol solution of potassium hydroxide. Then, the above described diazotized solution was added to the solution at a temperature range between 5° C. and 8° C. After stirring at 5° C. for 30 minutes, the mixture was neutralized with diluted hydrochloric acid and the resulting red purple colored precipitate was collected by filtration and recrystallized from ethyl acetate to obtain Dye Releasing Compound (1).

SYNTHESIS EXAMPLE 2

Synthesis of Dye Releasing Compound (2)

5.46 g (0.01 mol) of Compound [1-a] was diazotized in the same manner as described in [1-b].

To a mixture composed of 2.08 g (0.01 mol) of 1-carboxymethyl-3-cyano-6-hydroxy-4-methyl-2-pyridone, 0.4 g of sodium hydroxide, 5 g of sodium acetate, 30 ml of methyl Cellosolve and 5 ml of water was added the above described diazotized solution at a temperature range between 5° C. and 10° C. After stirring at 10° C. for 30 minutes, the mixture was acidified with diluted hydrochloric acid and the resulting yellow colored crystals were collected by filtration and recrystallized from acetonitrile to obtain 5.6 g of Dye Releasing Compound (2).

SYNTHESIS EXAMPLE 3

Synthesis of Dye Releasing Compound (3)

In the same manner as described in [1-a], 2-(N-hexadecylcarbamoyl)-4-[2-(p-nitrophenoxy)ethoxy]-1-naphthol was obtained. A mixture composed of 17.8 g (0.03 mol) of this compound, 2 g of ammonium chloride, 200 ml of isopropanol and 20 ml of water was heated at 50° C. Then, 12 g of a reduced iron was added little by little at a temperature range between 50° C. and 60° C. and the mixture was refluxed by heating for 1 hour. The mixture was filtered while it was still hot, the filtrate was allowed to cool and the crystals thus deposited were collected by filtration and washed with water and then methanol to obtain 15.8 g of 2-(N-hexadecylcarbamoyl)-4-[2-(p-aminophenoxy)ethoxy]-1-naphthol [3-a].

5.62 g (0.01 mol) of Compound [3-a] was dissolved in 20 ml of dimethylacetamide, 10 ml of tetrahydrofuran and 5 ml of pyridine and to which was added little by little 5.75 g (0.01 mol) of 4-(4-chlorosulfonylphenylazo)-2-N,N-diethylsulfamoyl-5-methylsulfonylamino-1-naphthol under cooling with ice. After stirring at room temperature for 30 minutes, the reaction solution was poured into cool diluted hydrochloric acid and the resulting orange red colored precipitate was collected by filtration and recrystallized from ethyl acetate to obtain the purified product of Dye Releasing Compound (3).

SYNTHESIS EXAMPLE 4

Synthesis of Dye Releasing Compound (4)

5.62 g (0.01 mol) of Compound [3-a] was dissolved in 20 ml of dimethylacetamide, 10 ml of tetrahydrofuran and 5 ml of pyridine and to which was added little by little 6.26 g (0.01 mol) of 5-(3-chlorosulfonylphenylsulfonylamino)-4-(2-methylsulfonyl-4-nitrophenylazo)-1-naphthol under cooling with ice. After stirring at room temperature for 20 minutes, the reaction solution was poured into cool diluted hydrochloric acid and the resulting red brown colored precipitate was collected by filtration and purified by a silica gel chromatography (methanol-chloroform) to obtain Dye Releasing Compound (4).

The dye releasing compound which releases a diffusible dye according to the present invention can be used in an amount of a certain concentration range. Generally, a suitable concentration range is from about 0.01 mol to about 4 mols of the dye releasing compound per mol of the organic silver salt oxidizing agent. A particularly suitable amount in the present invention is in a range of about 0.05 to about 1 mol per mol of the organic silver salt oxidizing agent.

The light-sensitive silver halide used in the present invention is contained in an amount in the range of 0.005 mol to 5 mols and, preferably 0.005 mol to 1.0 mol per mol of the organic silver salt oxidizing agent.

Examples of silver halide include silver chloride, silver chlorobromide, silver chloroiodide, silver bromide, silver iodobromide, silver chloroiodobromide and silver iodide, etc.

The silver halide has a particle size of from 0.001 μm to 2 μm and, preferably, from 0.001 μm to 1 μm.

The silver halide used in the present invention may be used as is. However, it may be chemically sensitized with a chemical sensitizing agent such as compounds of sulfur selenium or tellurium, etc., or compounds of gold, platinum, palladium, rhodium or iridium, etc., a reducing agent such as tin halide, etc., or a combination thereof. The details thereof are described in T. H. James, The Theory of the Photographic Process, the Fourth Edition, Chapter 5, pp. 149 to 169.

The organic silver salt oxidizing agent which can be used in the present invention is a silver salt which is comparatively stable to light and which forms a silver image by reacting with the above described image forming compound or a reducing agent coexisting, if necessary, with the image forming compound, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73 (the term "OPI" as used herein refers to a "published unexamined Japanese patent application"), a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in Research Disclosure, Vol. 170, No. 17029 (June, 1978) and an organic metal salt such as copper stearate, etc., are examples of the organic metal salt oxidizing agent capable of being used in the present invention.

The organic silver salt oxidizing agent preferably includes a silver salt of a carboxylic acid derivative and an N-containing heterocyclic compound.

The mechanism of the heat development process under heating in the present invention is not entirely clear, but it is believed to be as follows.

When the photographic material is exposed to light, a latent image is formed in a light-sensitive silver halide. This phenomenon is described in T. H. James, The Theory of the Photographic Process, Third Edition, pages 105 to 148.

When the photographic material is heated, the reducing agent reduces the organic metal salt oxidizing agent in the presence of the latent image nuclei as a catalyst to form silver, while it is oxidized itself. The oxidized product of the reducing agent reacts with the dye releasing compound (the so-called oxidative coupling) whereby a dye is released.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic metal salt oxidizing agent which are separately formed can be mixed prior to use to prepare a coating solution, but it is also effective to blend both of them in a ball mill for a long period of time. Further, it is effective to use a process which comprises adding a halogen containing compound to the organic silver salt oxidizing agent prepared to form silver halide using silver of the organic silver salt oxidizing agent.

Methods of preparing these silver halide and organic silver salt oxidizing agents and manners of blending them are described in Research Disclosure, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg to 10 g/m$^2$ calculated as an amount of silver.

The light-sensitive silver halide and the organic silver salt oxidizing agent used in the present invention are prepared in the binder as described below. Further, the dye releasing compound is dispersed in the binder described below.

The binder which can be used in the present invention can be employed individually or in a combination of two or more. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The hydrophilic binder preferably includes gelatin and a gelatin derivative.

The reducing agent which can be used in the present invention is oxidized by the organic silver salt oxidizing agent to form an oxidized product capable of reacting with the dye releasing compound and releasing a dye to form a color image. An example of an effectively used reducing agent having such an ability is a color developing agent capable of forming an image upon oxidative coupling. Examples of the reducing agents used in the heat-developable color photographic material according to the present invention include a p-phenylenediamine type color developing agent including N,N-diethyl-3-methyl-p-phenylenediamine which is a typical example as described in U.S. Pat. No. 3,531,286. Further, an example of an effective reducing agent is an aminophenol as described in U.S. Pat. No. 3,761,270. Of the aminophenol type reducing agents, 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc., are particularly useful. Further, a 2,6-dichloro-4-substituted sulfonamidophenol, and a 2,6-dibromo-4-substituted sulfonamidophenol, etc., as described in Research Disclosure, Vol. 151, No. 15108 and U.S. Pat. No. 4,021,240 are also useful. In addition to the phenol type reducing agents described above, a naphthol type reducing agent, for example, a 4-aminonaphthol derivative and a 4-substituted sulfonamidonaphthol derivative is useful. Moreover, a generally applicable color developing agent, an aminohydroxy pyrazole derivative as described in U.S. Pat. No. 2,895,825, an aminopyrazoline derivative as described in U.S. Pat. No. 2,892,714, a hydrazone derivative as described in Research Disclosure, pages 227 to 230 and 236 to 240, Nos. RD-19412 and RD-19415 (June, 1980) may also be used. These reducing agents can be used individually or in a combination of two or more thereof.

The reducing agent preferably includes a p-aminophenol, a p-phenylenediamine, a hydrazone and derivatives thereof.

In addition to the above described reducing agents, a reducing agent described below may be used as an auxiliary developing agent. Examples of useful auxiliary developing agents include hydroquinone, an alkyl substituted hydroquinone such as tertiary butylhydroquinone or 2,5-dimethylhydroquinone, etc., a catechol, a pyrogallol, a halogen substituted hydroquinone such as chlorohydroquinone or dichlorohydroquinone, etc., an alkoxy substituted hydroquinone such as methoxyhydroquinone, etc., and a polyhydroxybenzene derivative such as methyl hydroxynaphthalene, etc. Further, methyl gallate, ascorbic acid, an ascorbic acid derivative, a hydroxylamine such as N,N'-di(2-ethoxyethyl)-hydroxylamine, etc., a pyrazolidone such as 1-phenyl-3-pyrazolidone or 4-methyl-4-hydroxymethyl-1-phenyl-3-pyrazolidone, etc., a reductone and a hydroxy tetronic acid are also useful.

The reducing agent can be used in a certain range of concentration. In general, a suitable concentration range of the reducing agent is from about 0.1 mol to about 4 mols of the reducing agent per mol of the oxidizing agent. A suitable concentration of the reducing agent used in the present invention is generally from about 0.1 mol to about 20 mols of the reducing agent per mol of the oxidizing agent.

In the heat-developable color photographic material of the present invention, various kinds of bases and base releasing agents can be employed. By the use of the base or base releasing agent, a desirable color image can be obtained at a lower temperature.

Examples of preferred bases are amines which include a trialkylamine, a hydroxyalkylamine, an aliphatic polyamine, an N-alkyl substituted aromatic amine, an N-hydroxyalkyl substituted aromatic amine and a bis[p-(dialkylamino)phenyl]methane. Further, betaine tetramethylammonium iodide and diaminobutane dihydrochloride as described in U.S. Pat. No. 2,410,644, and urea and an organic compound including an amino acid such as 6-aminocaproic acid as described in U.S. Pat. No. 3,506,444 are useful. The base releasing agent is a compound or a mixture which releases a basic component by heating, and the basic component is capable of activating the photographic material. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid, etc., and examples of suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 are preferably used because it decomposes at a high temperature to form a base.

Further, in the heat-developable color photographic material of the present invention, many known compounds which activate development and simultaneously stabilize the image can be effectively used. Of these compounds, an isothiuronium including 2-hydroxyethylisothiuronium trichloroacetate as described in U.S. Pat. No. 3,301,678, a bisisothiuronium including 1,8-(3,6-dioxaoctane)-bis(isothiuronium trifluoroacetate), etc., as described in U.S. Pat. No. 3,669,670, a thiol compound as described in West German Patent Application (OLS) No. 2,162,714, a thiazolium compound such as 2-amino-2-thiazolium trichloroacetate and 2-amino-5-bromoethyl-2-thiazolium trichloroacetate, etc., as described in U.S. Pat. No. 4,012,260, a compound having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and a compound having 2-carboxyamide as an acid part as described in U.S. Pat. No. 4,088,496, and the like are preferably used.

These compounds or mixtures thereof can be used in an amount of a wide range. It is preferable to use them in a range of 1/100 to 10 times and, preferably, 1/20 to 2 times by molar ratio based on silver.

In the heat-developable color photographic materials of the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols described in U.S. Pat. No. 3,347,675, for example, polyethylene glycol having an average molecular weight of 1,500 to 20,000, derivatives of polyethylene oxide such as oleic acid ester, etc., beeswax, monostearin, compounds having a high dielectric constant which have $-SO_2-$ or $-CO-$ such as acetamide, succinimide, ethylcarbamate, urea, methylsulfonamide or ethylene carbonate, polar substances described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate described in Research Disclosure, pp. 26 to 28 (Dec., 1976), etc.

In the present invention, though it is not necessary to incorporate substances or dyes for preventing irradiation or halation in the photographic materials, because the photographic materials are colored by the dye releasing compound, it is possible to add filter dyes or light absorbent materials, etc., described in Japanese Patent Publication No. 3692/73 and U.S. Pat. Nos. 3,253,921, 2,527,583 and 2,956,879 in order to improve sharpness. It is preferred that these dyes have a thermal bleaching property. For example, dyes described in U.S. Pat. Nos. 3,769,019, 3,745,009 and 3,615,432 are preferred.

The photographic materials according to the present invention may contain, if necessary, various additives known for the heat-developable photographic materials and may have a layer other than the light-sensitive layer, for example, an antistatic layer, an electrically conductive layer, a protective layer, an intermediate layer, an AH layer and a strippable layer, etc. Examples of additives include those described in Research Disclosure, Vol. 170, No. 17029 (June, 1978), for example, plasticizers, dyes for improving sharpness, AH dyes, sensitizing dyes, matting agents, surface active agents, fluorescent whitening agents and fading preventing agents, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 3,681,294 and drying, likewise the case of the heat-developable photographic layer of the present invention, by which the photographic material is obtained.

If necessary, two or more layers may be applied at the same time by the method described in U.S. Pat. No. 2,761,791 and British Pat. No. 837,095.

For the heat-developable photographic materials of the present invention, various means for exposing to light can be used. Latent images are obtained by imagewise exposure by radiant rays including visible rays.

Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

As the original, not only line drawings but also photographs having gradation may be used. Further, it is possible to take a photograph of a portrait or landscape by means of a camera. Printing from the original may be carried out by contact printing by putting the original so as to closely contact therewith or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and forcusing the resulting image on the heat-developable photographic material by contacting therewith or by means of a lens.

Recently, LED (light-emitting diode) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to release a yellow dye, a magenta dye and a cyan dye, respectively.

The photographic material is produced using a construction such that the green-sensitive part (layer) contains a yellow dye releasing compound, the red-sensitive part (layer) contains a magenta dye releasing compound and the infrared-sensitive part (layer) contains a cyan dye releasing compound. Other combinations can be utilized, if necessary.

In addition to the above described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing, the so-called image treatment, and resulting image information is reproduced on CRT which can be utilized as an imagelike light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range, Particularly, a temperature range of about 110° C. to about 160° C. is useful. As the heating means, a simple heat plate, iron, heat roller or analogues thereof may be used.

In the present invention, a specific method for forming a color image by heat development comprises diffusion transfer of a hydrophilic diffusible dye. For this purpose, the heat-developable color photographic material is composed of a support having thereon a light-sensitive layer (I) containing at least silver halide, an organic silver salt oxidizing agent, a reducing agent for the silver halide and/or the organic silver salt oxidizing agent, a dye releasing compound and a hydrophilic binder, and an image receiving layer (II) capable of receiving the hydrophilic diffusible dye formed in the light-sensitive layer (I).

The above described light-sensitive layer (I) and the image receiving layer (II) may be formed on the same support, or they may be formed on different supports, respectively. The image receiving layer (II) can be stripped off the light-sensitive layer (I). For example, after the heat-developable color photographic material is exposed imagewise to light, it is developed by heating uniformly and thereafter the image receiving layer (II) is peeled apart.

In accordance with another process, after the heat-developable color photographic material is exposed imagewise to light and developed by heating uniformly, the dye can be transferred on the image receiving layer (II) by superposing the image receiving layer on the light-sensitive layer (I) and heating to a temperature lower than the developing temperature. The temperature lower than the developing temperature in such a case includes room temperature and preferably a temperature from room temperature to a temperature not less than about 40° C. lower than the heat developing temperature. For example, a heat developing temperature and a transferring temperature are 120° C. and 80° C., respectively. Further, there is a method wherein only the light-sensitive layer (I) is exposed imagewise to light and then developed by heating uniformly by superposing the image receiving layer (II) on the light-sensitive layer (I).

The image receiving layer (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing hetero-ring moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of crosslinking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78, and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of crosslinking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

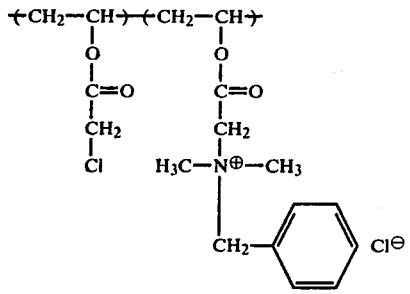

(2) Reaction products between a copolymer of a monomer represented by the following general formula with another ethylenically unsaturated monomer and a cross-linking agent (for example, bisalkanesulfonate, bisarenesulfonate, etc.):

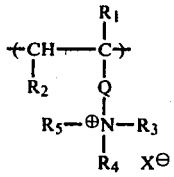

wherein $R_1$ represents H or an alkyl group, $R_2$ represents H, an alkyl group or an aryl group, Q represents a divalent group, $R_3$, $R_4$ and $R_5$ each represents an alkyl group, an aryl group or at least two of $R_3$ to $R_5$ are bonded together to form a hetero ring, and X represents an anion. The above described alkyl groups and aryl groups may be substituted.

(3) Polymers represented by the following general formula

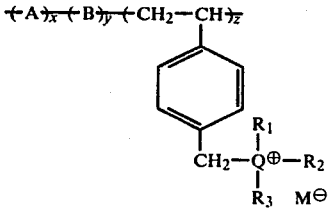

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1$, $R_2$ and $R_3$ each represents an alkyl group or a cyclic hydrocarbon group or at least two of $R_1$ to $R_3$ are bonded together to form a ring (these groups and rings may be substituted), and M represents an anion.

(4) Copolymers composed of (a), (b) and (c), wherein (a) is

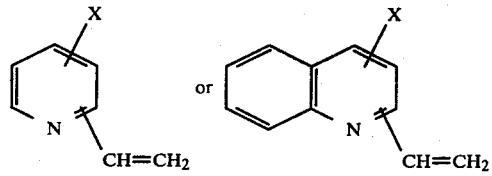

wherein X represents hydrogen, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

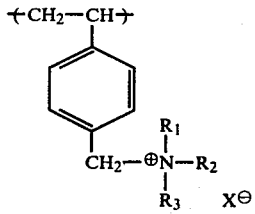

wherein $R_1$, $R_2$ and $R_3$ each represents an alkyl group, with the total number of carbon atoms being 12 or more (the alkyl group may be substituted), and X represents an anion.

Various known gelatins can be employed in the mordant layer. For example, gelatin which is produced in a different manner such as lime processed gelatin, acid processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the imageforming process used. Preferably, the ratio of mordant to gelatin is from about 20/80 to 80/20 (by weight) and the amount of the mordant coated is from 0.5 to 8 g/m$^2$.

The image receiving layer (II) can have a white-reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical image receiving materials for diffusion transfer are obtained by mixing the polymer containing ammonium salt groups with gelatin and applying the mixture to a transparent support.

The transfer of dyes from the photographic layer to the image receiving layer can be carried out using a transfer solvent. Examples of useful transfer solvents include water and an alkaline aqueous solution containing sodium hydroxide, potassium hydroxide, an inorganic alkali metal salt, etc. Further, a solvent having a low boiling point such as methanol, N,N-dimethylformamide, acetone, diisobutyl ketone, etc., and a mixture of such a solvent having a low boiling point with water or an alkaline aqueous solution can be used. The transfer solvent can be employed by wetting the image receiving layer with the transfer solvent or by incorporating it in the form of water of crystallization or microcapsules into the photographic material.

The present invention will be explained in greater detail with reference to the following examples, but the present invention should not be construed as being limited thereto.

EXAMPLE 1

6.5 g of benzotriazole and 10 g of gelatin were dissolved in 1,000 ml of water and the solution was stirred while it was maintained at 50° C. A solution containing 8.5 g of silver nitrate dissolved in 100 ml of water was added to the above described solution for a period of 2 minutes. Then, a solution containing 1.2 g of potassium bromide dissolved in 50 ml of water was added for a period of 2 minutes. By controlling the pH of the emulsion thus prepared to precipitate the excess salts were removed. The pH of the emulsion was then adjusted to 6.0 and 200 g of the emulsion was obtained.

In the following, a method of preparing a gelatin dispersion of a dye releasing compound is described.

A mixture of 10 g of Dye Releasing Compound (1), 0.5 g of sodium 2-ethylhexylsulfosuccinate as a surface active agent, 4 g of tricresyl phosphate (TCP) and 20 ml of cyclohexanone was heated at about 60° C. to form a uniform solution. The solution was mixed with 100 g of a 10% aqueous solution of lime processed gelatin and then dispersed using a homogenizer at 10,000 rpm for 10 minutes. The dispersion thus prepared is designated a dispersion of a dye releasing compound.

In the following, a method of preparing a light-sensitive coating is described.

| | | |
|---|---|---|
| (a) | a silver benzotriazole emulsion containing a light-sensitive silver bromide | 10 g |
| (b) | a dispersion of a dye releasing compound | 3.5 g |

(c) a solution containing 220 mg of guanidine trichloroacetate dissolved in 2 ml of water (d) a solution containing 200 mg of 2,6-dichloro-4-aminophenol dissolved in 2 ml of methanol The above-described components (a), (b), (c) and (d) were mixed and dissolved by heating. The solution was coated on a polyethylene terephthalate film having a thickness of 180μ at a wet thickness of 60 μm and dried. The sample thus prepared was exposed imagewise at 2,000 lux for 10 seconds using a tungsten lamp and then uniformly heated on a heat block which has been heated at 150° C. for 30 seconds.

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime processed gelatin. The mixture was uniformly coated on a polyethylene terephthalate film at a wet thickness of 20 μm and dried to prepare an image receiving material.

The image receiving material was soaked in water and superposed on the heated light-sensitive material described above and brought into contact with each of the surface layers. After 30 seconds, the image receiving material was peeled apart from the light-sensitive material to obtain a negative magenta color image on the image receiving material. The optical density of the negative image was measured using a Macbeth transmission densitometer (TD-504). The maximum density and the minimum density to green light were 1.80 and 0.12, respectively. Further, the gradation of the sensitometric curve had a density difference of 1.20 to an exposure difference of 10 times in the straight line part.

EXAMPLES 2 TO 4

The same procedure as described in Example 1 was repeated except using 10 g of Dye Releasing Compound (2) in place of Dye Releasing Compound (1) to prepare Light-Sensitive Material No. 2.

In the same manner, Light-Sensitive Material Nos. 3 and 4 were prepared using 10.5 g of Dye Releasing Compound (3) and 10.5 g of Dye Releasing Compound (4), respectively.

These Light-Sensitive Material Nos. 2 to 4 was subjected to the same process as described in Example 1 to obtain negative color images on the image receiving materials. The results of the optical density measurement are shown in the following table.

| Light-Sensitive Material No. | Dye Releasing Compound | Hue | Maximum Color Density | Minimum Color Density |
|---|---|---|---|---|
| 2 | (2) | Yellow | 1.0 | 0.10 |
| 3 | (3) | Magenta | 1.2 | 0.10 |
| 4 | (4) | Cyan | 1.6 | 0.15 |

While the invention has been described in detail and with reference to specific embodiments thereof, it will be apparent to one skilled in the art that various changes and modifications can be made therein without departing from the spirit and scope thereof.

What is claimed is:

1. A heat-developable color photographic material, comprising a support having thereon a layer containing a light-sensitive silver halide, an organic silver salt oxidizing agent, a hydrophilic binder, a reducing agent for the substance selected from the group consisting of the silver halide and the organic silver salt oxidizing agent and a dye releasing compound, wherein the dye releasing compound releases a hydrophilic diffusible dye and is represented by the following general formula:

C—L—D wherein C represents a moiety capable of bonding to an oxidized product which is formed by a reaction between a reducing agent and an organic silver salt oxidizing agent; D represents a dye portion for forming an image; and L represents a connection group between C and D and the bond between C and L is cleaved upon the reaction of C with the oxidized product of the reducing agent releasing the hydrophilic dye.

2. A heat-developable color photographic material as claimed in claim 1, wherein the moiety represented by C includes an active methylene residue, an active methine residue, a phenol residue or a naphthol residue.

3. A heat-developable color photographic material as claimed in claim 2, wherein the moiety represented by C is represented by the following general formula (I), (II), (III), (IV), (V), (VI) or (VII):

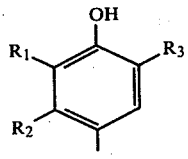

(I)

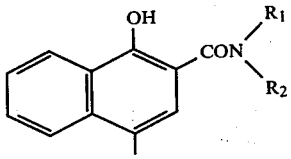

(II)

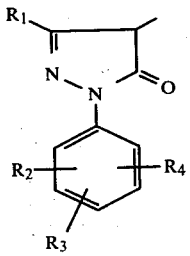

(III)

$R_1COCHCOR_2$ (IV)

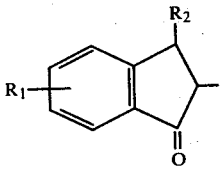

(V)

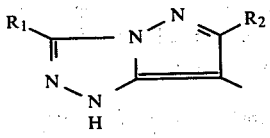

(VI)

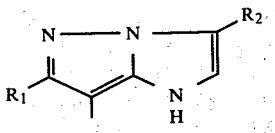

(VII)

wherein $R_1$, $R_2$, $R_3$ and $R_4$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group, and the total number of the carbon atoms contained in the groups of $R_1$, $R_2$, $R_3$ and $R_4$ is from 12 to 40.

4. A heat-developable color photographic material as claimed in claim 1, wherein the moiety represented by C contains a ballast group.

5. A heat-developable color photographic material as claimed in claim 4, wherein the ballast group is a hydrophobic group selected from an alkyl group, an alkoxyalkyl group or an aryloxyalkyl group.

6. A heat-developable color photographic material as claimed in claim 4, wherein a total number of the carbon atoms contained in the ballast group is from 6 to 40.

7. A heat-developable color photographic material as claimed in claim 1, wherein a total number of the carbon atoms contained in the moiety C is from 12 to 40.

8. A heat-developable color photographic material as claimed in claim 1, wherein the connecting group represented by L is a divalent group connecting between the moiety C and the dye portion D with a covalent bond.

9. A heat-developable color photographic material as claimed in claim 8, wherein the divalent group is selected from the group represented by the following general formulae:

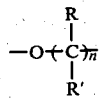

n = 0–3

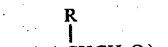

n = 1–2

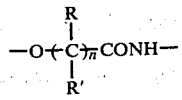

n = 0–3

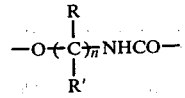

n = 1–3

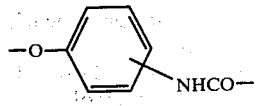

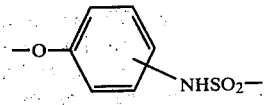

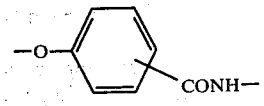

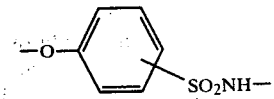

—NHCONH—

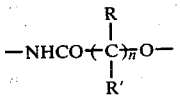

n = 0–3

-continued

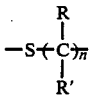

n = 0–3

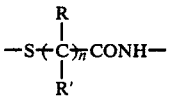

n = 1–3

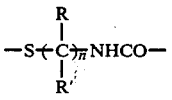

n = 1–3

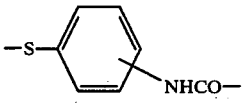

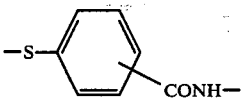

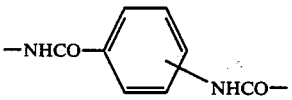

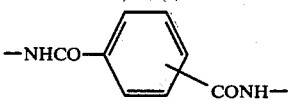

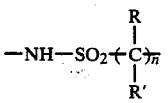

n = 0–3

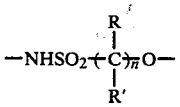

n = 1–4

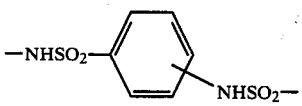

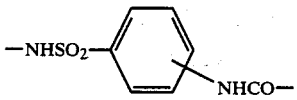

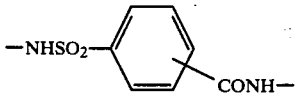

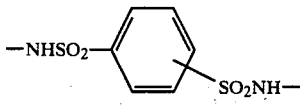

$-NHSO_2NHCONH-$

-continued

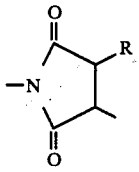

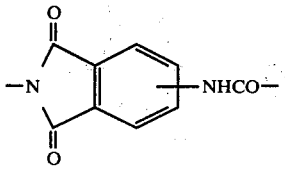

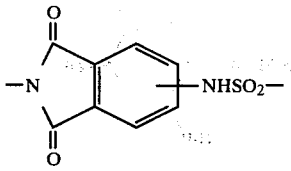

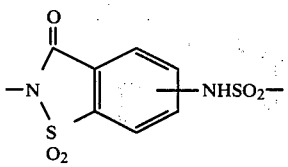

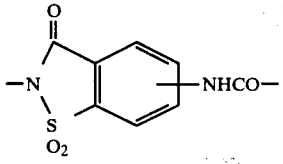

10. A heat-developable color photographic material as claimed in claim 8, wherein the divalent group is a group contains a total number of carbon atoms of not more than 12.

11. A heat-developable color photographic material as claimed in claim 1, wherein the dye portion represented by D includes an azo dye, an azomethine dye, an anthraquinone dye, a naphthoquinone dye, an indigoid dye, a carbonium ionic dye, a styryl dye, a quinoline dye, a nitro dye or a phthalocyanine dye.

12. A heat-developable color photographic material as claimed in claim 11, wherein the dye included in the dye portion represented by D is represented by the following general formulae:

Yellow:

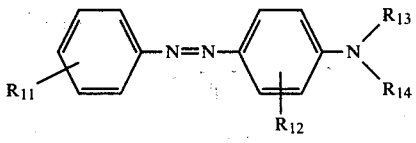

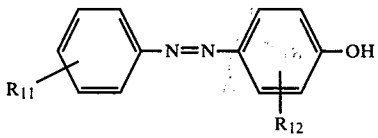

-continued
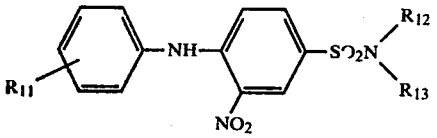
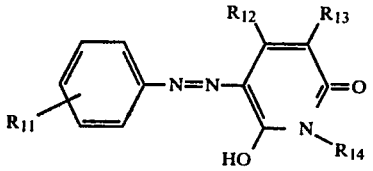
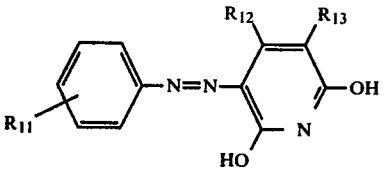
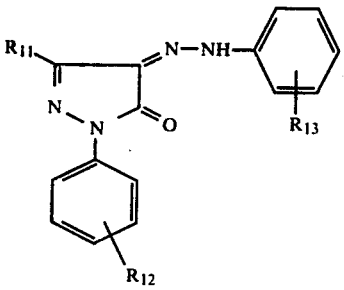
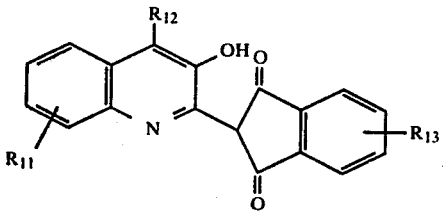
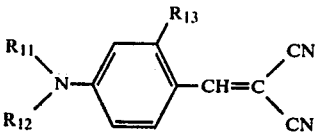
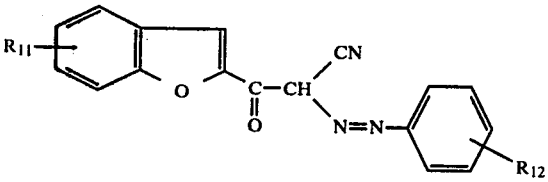
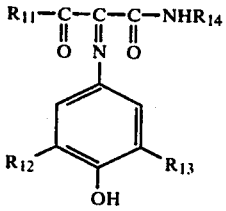
Magenta:
-continued
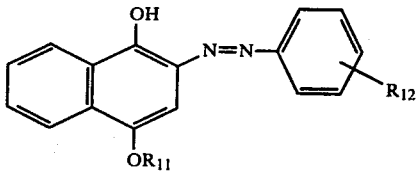
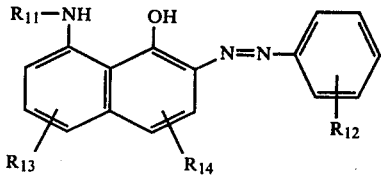
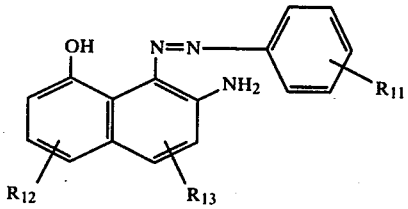
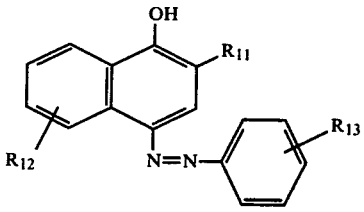
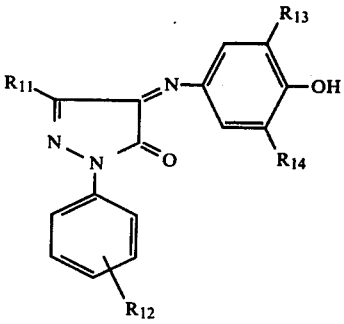
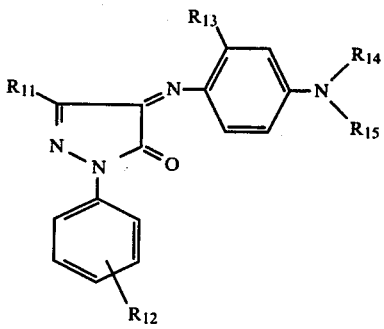
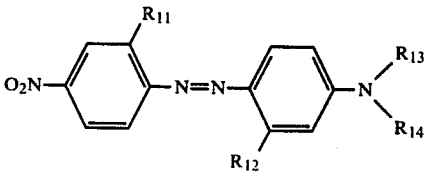

-continued
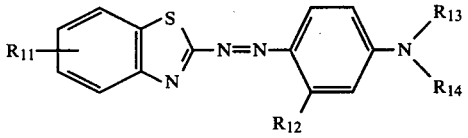
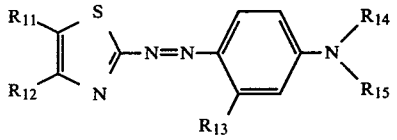
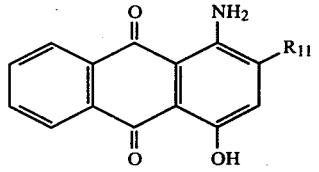
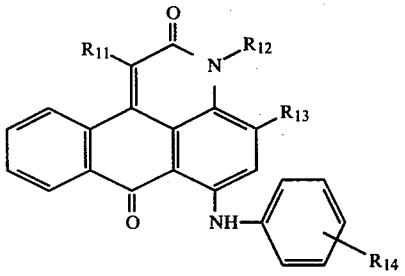
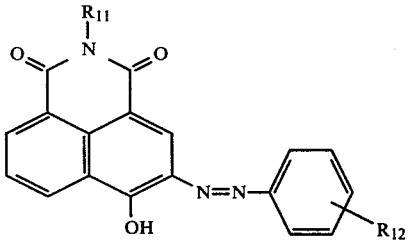
Cyan:
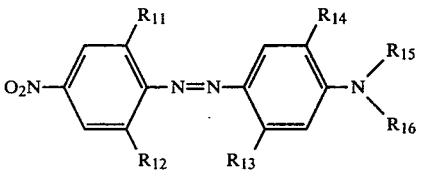
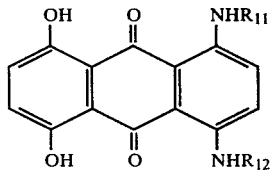
-continued
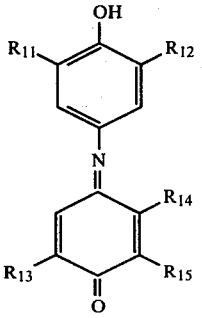
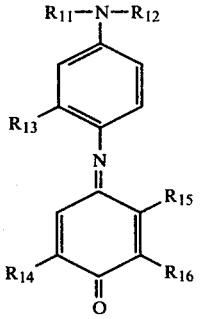
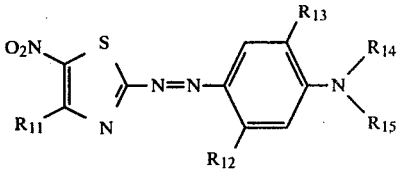
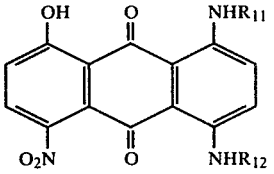
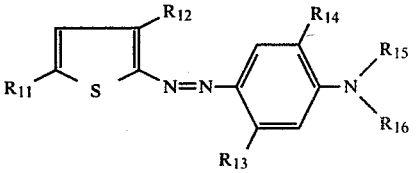
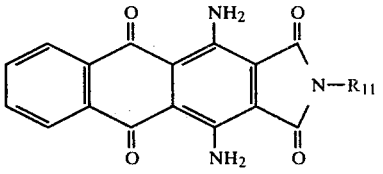

-continued

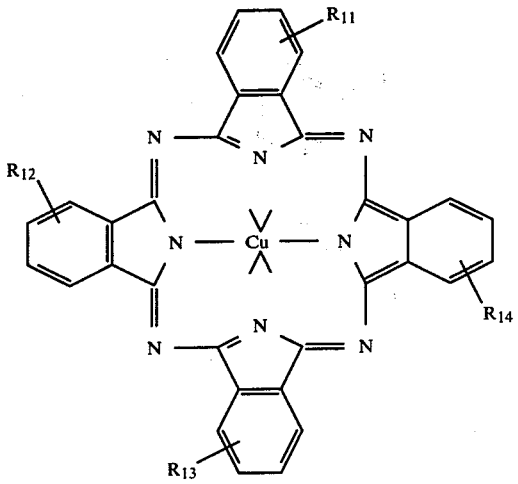

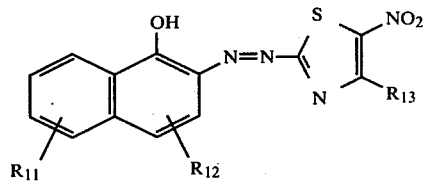

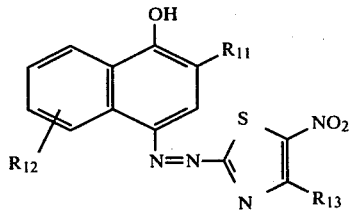

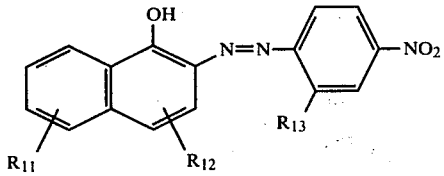

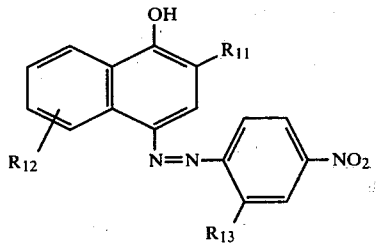

wherein $R_{11}$ to $R_{16}$, which may be the same or different, each represents hydrogen or a substituent selected from the group consisting of an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an aryloxyalkyl group, a nitro group, a halogen atom, a sulfamoyl group, an N-substituted sulfamoyl group, a carbamoyl group, an N-substituted carbamoyl group, a sulfamido group, an N-substituted sulfamido group, a hydroxyalkoxy group, an alkoxyalkoxy group, a carboxy group, an amino group, a substituted amino group, an alkylthio group, an arylthio group, a hydroxamic acid group and an imido group, each having up to 25 carbon atoms.

13. A heat-developable color photographic material as claimed in claim 1, wherein the dye portion represented by D has a group which imparts hydrophilicity which is selected from a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group and an alkoxyalkoxy group.

14. A heat-developable color photographic material as claimed in claim 1, wherein the dye portion represented by D has a group selected from a phenolic hydroxy group, a carboxy group, a sulfo group, a phosphoric acid group, an imido group, a hydroxamic acid group, a substituted or unsubstituted sulfamoyl group and a substituted or unsubstituted sulfamoylamino group.

15. A heat-developable color photographic material as claimed in claim 1, wherein the dye releasing compound is present in an amount of from 0.01 mol to 4 mols per mol of the organic silver salt oxidizing agent.

16. A heat-developable color photographic material as claimed in claim 1, wherein the light-sensitive silver halide is selected from the group consisting of silver chloride, silver chlorobromide, silver chloroiodide, silver bromide, silver iodobromide, silver chloroiodobromide and silver iodide.

17. A heat-developable color photographic material as claimed in claim 1, wherein the light-sensitive silver halide is present in a range of from 0.005 mol to 5 mols per mol of the organic silver salt oxidizing agent.

18. A heat-developable color photographic material as claimed in claim 1, wherein the particle size of the silver halide is from 0.001 $\mu$m to 2 $\mu$m.

19. A heat-developable color photographic material as claimed in claim 1, wherein the organic silver salt oxidizing agent is a silver salt which forms silver by reacting with the reducing agent, when it is heated to a temperature of above 80° C. in the presence of exposed silver halide.

20. A heat-developable color photographic material as claimed in claim 1, wherein the organic silver salt oxidizing agent is a silver salt of an organic compound having a carboxy group, a silver salt of a compound containing a mercapto group or a thione group or a silver salt of a compound containing an imino group.

21. A heat-developable color photographic material as claimed in claim 20, wherein the organic silver salt oxidizing agent is a silver salt of a carboxylic acid derivative or an N-containing heterocyclic compound.

22. A heat-developable color photographic material as claimed in claim 1, wherein the light-sensitive silver halide and the organic silver salt oxidizing agent are present in the same layer.

23. A heat-developable color photographic material as claimed in claim 1, wherein the hydrophilic binder is gelatin or a gelatin derivative.

24. A heat-developable color photographic material as claimed in claim 1, wherein the reducing agent is a compound which is oxidized by the organic silver salt oxidizing agent to form an oxidized product capable of reacting with the dye releasing compound and releasing a dye.

25. A heat-developable color photographic material as claimed in claim 24, wherein the reducing agent is a color developing agent which is capable of forming an image upon oxidative coupling.

26. A heat-developable color photographic material as claimed in claim 24, wherein the reducing agent is selected from the group consisting of a p-phenylenediamine type color developing agent, an aminophenol compound, an aminonaphthol compound, an aminohydroxypyrazole compound, an aminopyrazoline compound and a hydrazone compound.

27. A heat-developable color photographic material as claimed in claim 24, wherein the reducing agent is selected from the group consisting of a p-aminophenol, a p-phenylenediamine, a hydrazone and derivatives thereof.

28. A heat-developable color photographic material as claimed in claim 1, wherein the color photographic material further contains an auxiliary developing agent.

29. A heat-developable color photographic material as claimed in claim 1, wherein the reducing agent is present in an amount of from 0.1 mol to 20 mols per mol of the oxidizing agent.

30. A heat-developable color photographic material as claimed in claim 1, wherein a color photographic material further contains a base or a base releasing agent.

31. A heat-developable color photographic material as claimed in claim 30, wherein the base releasing agent is a salt of a carboxylic acid and an organic base.

32. A heat-developable color photographic material as claimed in claim 30, wherein the base releasing agent is guanidine trichloroacetate.

33. A heat-developable color photographic material as claimed in claim 1, wherein the color photographic material further contains a thermal solvent.

34. A heat-developable color photographic material as claimed in claim 1, wherein the color photographic material further comprises an image receiving layer capable of receiving the hydrophilic diffusible dye.

35. A heat-developable color photographic material as claimed in claim 34, wherein the image receiving layer contains a dye mordant.

36. A heat-developable color photographic material as claimed in claim 34, wherein the image receiving layer contains a polymer mordant and gelatin.

37. A heat-developable color photographic material as claimed in claim 1, wherein the color photographic material further contains a transfer solvent.

38. A heat-developable color photographic material as claimed in claim 37, wherein the transfer solvent is selected from the group consisting of water and an alkaline aqueous solution.

39. A method of forming a color image which comprises imagewise exposing the heat-developable color photographic material as claimed in claim 1, developing the exposed color photographic material by uniformly heating to release a hydrophilic diffusible dye and transferring the diffusible dye into an image receiving material.

40. A method of forming a color image as claimed in claim 39, wherein the heating is carried out at a temperature ranging from 80° C. to 250° C.

41. A method of forming a color image as claimed in claim 39, wherein the transferring of the diffusible dye is carried out using a transfer solvent.

42. A method of forming a color image as claimed in claim 40, wherein the transfer solvent is selected from the group consisting of water and an alkaline aqueous solution.

43. A method of forming a color image as claimed in claim 39, wherein the image receiving material contains a mordant for the diffusible dye.

* * * * *